United States Patent [19]

Alexander

[11] Patent Number: 4,812,289

[45] Date of Patent: Mar. 14, 1989

[54] OXIDE DISPERSION HARDENED ALUMINUM COMPOSITION

[75] Inventor: Guy B. Alexander, Salt Lake City, Utah

[73] Assignee: Technical Research Assoc., Inc., Salt Lake City, Utah

[21] Appl. No.: 129,233

[22] Filed: Dec. 7, 1987

Related U.S. Application Data

[60] Division of Ser. No. 902,946, Sep. 2, 1986, Pat. No. 4,731,132, which is a continuation-in-part of Ser. No. 654,476, Sep. 26, 1984, abandoned.

[51] Int. Cl.[4] ..... C22C 21/00; B22F 9/00

[52] U.S. Cl. ..... 420/528; 420/533; 419/19; 419/20; 75/0.5 A; 75/0.5 B

[58] Field of Search ..... 420/528, 529, 533; 75/0.5 A, 0.5 B; 419/19, 20

[56] References Cited

U.S. PATENT DOCUMENTS

| | | | |
|---|---|---|---|
| 2,793,949 | 5/1957 | Imich | 420/533 |
| 3,600,163 | 8/1971 | Badia et al. | 420/529 |
| 3,816,080 | 6/1974 | Bomford et al. | 148/437 |

FOREIGN PATENT DOCUMENTS

| | | | |
|---|---|---|---|
| 678294 | 1/1964 | Canada | 419/19 |
| 159737 | 3/1985 | Japan | 420/542 |

*Primary Examiner*—L. Dewayne Rutledge
*Assistant Examiner*—George Wyszomierski
*Attorney, Agent, or Firm*—Marshall, O'Toole, Gerstein, Murray & Bicknell

[57] ABSTRACT

Refractory metal oxide particles are dispersed in an aluminum melt which is then cast to form a dispersion hardened aluminum alloy composition. A master mix of carrier metal particles surrounding individual oxide particles is pressed into a billet. The billet is dissolved in the melt in the presence of a wetting metal.

21 Claims, No Drawings

OXIDE DISPERSION HARDENED ALUMINUM COMPOSITION

This invention was made with government support under Contract No. F49620-83-C-0162 awarded by the U.S. Department of Defense and Contract No. 1S1-85-60867 awarded by the National Science Foundation. The Government has certain rights in this invention.

RELATED CASE

This is a division of application Ser. No. 902,946, filed Sept. 2, 1986, now U.S. Pat. No. 4,731,132 issued Mar. 15, 1988, which is a continuation-in-part of applicant's abandoned application Ser. No. 654,476 filed Sept. 26, 1984 and entitled "Oxide Dispersion Hardened Aluminum Composition".

BACKGROUND OF THE INVENTION

1. Field

This invention relates to dispersion strengthening of metals. It is specifically directed to the dispersion strengthening of aluminum alloys, and provides a family of such alloys capable of withstanding welding temperatures.

2. State of the Art

Dispersion strengthened metals and methods for enhancing various properties of metals through the dispersion of refractory particles in a metal or alloy are well known. Such metals and processes are disclosed, for example, in U.S. Pat. Nos. 3,028,234 (Alexander, et al.); 3,290,144 (Iler, et al.); and 3,468,658 (Herald, et al.); the disclosures of which are incorporated by reference.

Alexander, et al. is directed to a general method for mixing a powdered solid dispersion of refractory metal oxide particles in an inactive metal with a molten mass of metal to be hardened (notably nickel). Alexander, et al. suggest (in Example 1) that a copper-alumina powder may be added to a molten aluminum alloy. In practice, however, when the procedures of Example 1 are followed, the copper-aluminum powder does not dissolve in the aluminum alloy and thus does not produce a satisfactory dispersion hardened aluminum alloy. Alexander, et al. also teach protecting the copper-aluminum powder in an inert atmosphere to prevent oxidation of the copper prior to adding it to molten aluminum. Alexander, et al. also suggest sintering the powder prior to its introduction to the melt.

Iler, et al. disclose a mechanical method for producing dispersion hardened copper. The method includes the production of a dense billet composed of copper powder with alumina particles dispersed therein. The copper powder is obtained by reducing a copper compound, and is protected by an inert atmosphere to avoid reoxidation prior to being pressed into the dense billet.

Herald, et al. suggest adding a dispersoid such as aluminum oxide to metals in a molten state. Agglomeration is avoided by wetting the dispersoid with the metal to be hardened. "Wetting" is achieved by saturating the metal with the anion of the dispersoid while the dispersoid is being mixed with the molten metal.

SAP (sintered aluminum powder) metal is an example of an oxide metal dispersion hardened aluminum alloy which is known to have a service temperature as much as 200° C. higher than typical aluminum alloys. SAP is produced by mechanical working methods. While it has excellent properties, those properties are permanently destroyed at temperatures approaching welding temperatures.

Other U.S. Patents reflecting the state of the art include Badia et al, U.S. Pat. No. 3,600,163 which teaches the dispersion of graphite in molten aluminum, employing a wetting process. The graphite particles are preferably 40 microns in average cross section size, but graphite particles as small as 20 microns reportedly have given excellent results.

Imich, U.S. Pat. No. 2,793,949 teaches wetting particles of ceramic materials such as emery, corundum, burned alumina, flint, quartz and others into various molten metals. Imich produces composite materials which generally contain 5 to 50 volume percent of the ceramic material. Particle sizes for the ceramic material range from 0.5 microns (Example 11), up to 30 mm in Example 6.

SUMMARY OF THE INVENTION

An objective of the present invention is to provide an aluminum base alloy which has high strength at 500° F. (260° C.) and ductility enough to behave like a metal, which means that the product can be worked, formed and shaped without excessive cracking. As used herein, the terms "aluminum" and "aluminum alloy" are used interchangeably unless it is otherwise indicated or apparent.

The following combination of features is necessary to give this kind of product: (a) discrete particles of refractory oxide (strengthening oxide) dispersed throughout a matrix consisting essentially of aluminum or aluminum alloy; (b) an interparticle spacing less than 0.2 microns, preferably in the range of 0.05–0.15 microns; (c) a particle size in the range 0.005–0.025 microns; (d) a volume percent for the strengthening oxide no greater than 1 vol. % in order to preserve ductility; and (e) a strengthening oxide which is stable in a molten bath of aluminum or aluminum alloy and will not undergo Ostwald ripening, which means that the oxide must have a relatively high free energy of formation and a relatively high melting point.

This invention provides an oxide dispersion hardened aluminum composition with better high temperature properties than are characteristic of currently available aluminum alloys. Practical use temperatures in excess of 500° F. (260° C.) are feasible with the alloys of this invention. The compositions of this invention can replace titanium based alloys in some applications where service temperatures exceed the capabilities of current aluminum alloys. Parts fabricated from the dispersion hardened compositions of this invention may be welded in the field without significant degradation of properties.

The oxide dispersion hardened aluminum compositions of this invention comprise an alloy of aluminum containing a wetting metal and internally dispersed refractory metal oxide dispersoid particles (also referred to herein as "strengthening oxide" or "metal oxide filler"). The wetting metal and dispersoids are each present in effective amounts, which vary over broad ranges depending upon the properties desired for the metallic product (i.e. the hardened aluminum composition) and the particular substances chosen for use. For strengthening purposes, sufficient dispersoid is present so that it occupies at least 0.05 volume percent of the metallic product and up to about 1 vol. %. The term "refractory metal oxide" or "strengthening oxide" is intended to include, in addition to the oxides, any refractory metal compound (most notably the hydroxides or hydrated oxides), which upon calcination converts to the oxide form.

Preferred dispersoids are selected from the group consisting of alumina, zirconia, magnesia, thoria and rare earth oxides, including the oxides of rare earth metals having an atomic number from 59–71. These dispersoids have a free energy of formation at 1000° C. of at least 100 Kcal per gram atom of oxygen in the oxide. In practice, alumina is usually the dispersoid of choice.

The size, shape, volume fraction and IPS of dispersoid particles are all important to the properties of the compositions of this invention. For purposes of this disclosure, where applicable, all such physical parameters are considered in a statistical sense with the recognition that an individual particle may differ appreciably from the mean or average characteristic specified.

The dispersoid is present in an amount effective to obtain the desired interparticle spacing (IPS) which is generally within the range of about 0.05 to 0.2 microns. IPS is correlated to, and thus approximately determinable from, the hardness and strength properties of the completed composition.

A preferred method of estimating the IPS of a composition is, first, to measure the particle size (the mean diameter) of the dispersoid particles by electron microscopy. Alternatively, the dispersoid particles may be extracted, and their surface areas measured. Then the volume fraction of the dispersoid in the composition is determined, e.g. by chemical analysis. From these two determinations, the IPS may be calculated by the relationship:

$$IPS = d[(1/1.9f)^{\frac{1}{3}} - 1)]$$

where d is the mean diameter of the dispersoid particles, and f is the volume fraction of the dispersoid in the system.

Compositions must be formulated with an IPS below 0.2 microns. The strongest, hardest alloys typically have an IPS in the range of about 0.05 to about 0.15 microns.

In the preferred embodiments of this invention, the dispersoid particles are approximately isometric; that is, they approach the shape of a sphere, cube or regular octahedron. Isometric particles are preferred over fibrous or plate-like particles which tend to make the melt viscous, and also can impart anisometric properties to the resulting cast alloy. It is preferred that the alloy compositions of this invention exhibit equivalent strength and hardness properties in all directions after casting. This objective is more nearly achieved by using isometric dispersoid particles.

As noted above, the volume percent of the dispersoid particles in the compositions of this invention is ordinarily in the range of about 0.05 to about 1 vol. %. In the preferred embodiments of the invention, the volume percent of the refractory or strengthening oxide (dispersoid) is in the range of about 0.05 to about 0.5 vol. %.

The particle size of the dispersoid particles is ordinarily in the size range of from about 0.005 to about 0.025 microns, more preferably within the range of about 0.005 to about 0.015 microns. Reference herein to "particle size" refers to the mean diameter of the particles as determined by conventional scanning electron microscope techniques.

Wetting the refractory metal oxide dispersoid with a wetting metal, when the dispersoid is added to the molten aluminum alloy, is an important consideration. The wetting metal should be reactive to form a metal oxide having a free energy of formation greater than that of the dispersoid or strengthening oxide.

Magnesium metal is a common constituent of aluminum alloys, and forms a very stable oxide. At a temperature of 1000° C. (1832° F.), magnesium has a free energy of formation of 112 KCal/Mol. Two of the oxides which can be used as dispersoids according to the present invention have the following published free energies of formation:

| Dispersoid | Free Energy at 1000° C. |
|---|---|
| Alumina | 104 |
| Zirconia | 100 |

Accordingly, magnesium is a preferred wetting metal for these two oxides. Similarly, aluminum is a wetting metal for zirconia. The surfaces of the dispersoid particles are converted to a metallophilic state by reacting the surface of the particle with a wetting metal of the type described, notably magnesium. In the case of the two above-noted metal oxide dispersoids of the present invention, magnesium will react with alumina to produce magnesia and aluminum and with zirconia to produce magnesia and zirconium.

The magnesium or other wetting metal normally reacts with the dispersoid to form a suboxide outer layer surrounding the dispersoid particles. (The term "suboxide" as used herein means oxygen-deficient as compared to pure metal oxide.) This suboxide outer layer is wetted (or attached) to both the metal oxide interior of the particle and the surrounding metal external the particle. In this manner, the strengthening oxides can be made metallophilic and wetted into a molten aluminum alloy. Aluminum, itself, will act as a wetting metal for zirconia. When magnesium is used as a wetting metal, its effective amount is typically between about 0.1 to about 4 wt. %, based upon the total weight of the composition.

Except for the oxide particles to be dispersed, very little additional oxygen can be tolerated in the system. Excess oxygen will consume the available magnesium or other wetting metal, leaving insufficient wetting metal to convert the intended dispersoid to a metallophilic condition. Excess oxygen, which can be associated with the dispersoid as copper oxide or iron oxide when the dispersoid is added to the melt, should be held to below about 0.1 wt. %, preferably less than about 0.05 wt. % and most preferably less than 0.01 wt. %, of the copper or iron present in the metallic product.

It is desirable to introduce a dispersoid into a molten aluminum bath under conditions which prevent dispersoid aggregation and particle growth. The presently preferred practice for such introduction is to first surround the dispersoid particles by a metal whose oxide is reducible with hydrogen. Metals which can be used in this way are copper and iron, and the resulting coated particles are referred to in this disclosure as an "iron or copper master mix."

A procedure which may be used to form an iron or copper-refractory oxide master mix is to coprecipitate the iron or copper as metal oxides or hydroxides around the particles of dispersoid metal oxide (refractory filler). The master mix includes sufficient carrying metal (iron and/or copper) to effectively surround or mechanically entrap individual particles of the dispersoid to keep them separated from each other. Excess amounts of carrying metal, while tolerable, are not desirable. In any event, the minimum effective amount and any incidental excess of these metals introduced to a melt with the master mix is referred to in this disclosure as a "carrier amount."

Master mixes useful for the preparation of dispersion hardened compositions of this invention will usually contain up to about 20 volume percent strengthening oxide or dispersoid, with about 5 to about 20 volume percent being considered the practical range and about 5 to about 10 volume percent being presently most preferred.

A number of conditions need to be met for the master mix to be adequately dispersed into an aluminum melt. (The term "aluminum melt" is used herein broadly to include substantially pure aluminum and the aluminum alloys of interest, notably the commercially available casting and working alloys.) First, the molten aluminum alloy must come in direct contact with the copper or iron of the master mix. Second, diffusion of aluminum into the copper or iron must take place to the extent necessary to solubilize and dissolve the copper or iron into the molten aluminum alloy. The melt must thus be hot enough for the mixed metals to be liquid, and allow diffusion and mixing to occur. The appropriate melt temperature can be determined from a relevant phase diagram, for example, a phase diagram of the copper and aluminum alloy in the melt (when copper is the metal in the master mix). Third, magnesium or other wetting metal (in some instances aluminum itself) included in the molten aluminum alloy must have the opportunity to react with the colloidal particles of strengthening oxide, rendering them metallophilic (wet by the molten aluminum alloy).

The master mix may be added to the molten aluminum alloy by first pressing it (typically at a pressure of about 30 tons per square inch) into a slug or billet. The billet is placed in a furnace and treated with hydrogen at a temperature effective to remove the surface copper oxide or iron oxide, and cause mild sintering. The mildly sintered billet is maintained in an inert (non-oxidizing), oxygen-free atmosphere until the billet is added to the molten aluminum alloy in an inert, oxygen-free atmosphere, such as nitrogen or argon.

If the billet should become surface oxidized, there is an undesirable tendency for the aluminum and other metals in the melt to react with the surface copper or iron oxide, deposit alumina around the billet, and thereby isolate the billet from the molten metal, preventing dissolution of the carrier metal (Cu or Fe) and the dispersion of the strengthening metal in the melt.

Colloidal particles of strengthening oxide of the size required by this invention, namely 0.005 to 0.025 microns, are very difficult to handle before and during addition to the melt because of problems with aggregation and coalescence. If coalescence occurs and the colloidal particles grow in size above 0.025 microns, the end result is a loss of strength.

To ensure dispersal of the colloidal sized particles of strengthening oxide (dispersoid) into the molten aluminum alloy as discrete individual particles, unaggregated and uncoalesced, steps are taken to keep the particles physically separated from each other prior to their actually being introduced to the melt. These steps comprise surrounding the individual particles of strengthening oxide with particles of carrier metal (e.g. Cu), and preventing the particles of carrier metal or the particles of carrier metal oxide from which the carrier metal was obtained by chemical reduction, from themselves coalescing or aggregating when the particles of strengthening oxide are dispersed in the former. Failure to keep the particles of strengthening oxide physically separated from each other will permit the particles to agglomerate when they come into contact with each other at the melt temperature.

In order to achieve high temperature strength and maintain ductility in the metallic products of this invention, it is essential that the volume percent of the colloidal particles be maintained below 1 vol. %. Simultaneously, in order to achieve high strength, it is essential that the interparticle spacing be less than 0.2 microns. In order to achieve these two requirements simultaneously, it is necessary that the colloidal particles be less than 0.025 microns in size. Larger particles will not give the hardening and strengthening effect desired at elevated temperatures. Such an effect is required if the metallic product is to be used in aircraft and aerospace components or in pistons and automotive engines which are to operate at temperatures higher than are currently available today, a desirable goal.

DETAILED DESCRIPTION

The following examples include what is presently regarded as the best mode for carrying out the invention.

EXAMPLE 1

An aqueous alumina sol was prepared by combining 358 grams of water with 2.4 grams of 70 percent nitric acid in a mixer at room temperature. 40 grams of alumina powder (supplied by Remet Corporation of Utica, N.Y.) was added to this mixture over a period of about 15 minutes with vigorous agitation to produce a sol containing 10 wt. % alumina.

Solutions were prepared as follows: (1) 206 grams $Cu(NO_3)_2 \cdot 2H_2O$ were dissolved and diluted to 500 ml. with distilled water; (2) 20 ml. of the above-described alumina sol was diluted to 500 ml. with distilled water; (3) a solution of ammonium hydroxide was prepared as described below. The concentration of the ammonium hydroxide was fixed by titrating a sample of the above-described copper nitrate solution with 4.5 Normal ammonium hydroxide ($NH_4OH$) solution to a pH of 5.7. The ammonium hydroxide concentration was then adjusted so that when equal volumes of the ammonium hydroxide solution and the copper nitrate solution were mixed, the pH was 5.7. 500 ml. of this ammonium nitrate solution were then used with the other two solutions described above. The three solutions were added to 100 ml. of water in a mixer, volumetrically at equal rates, to produce a precipitate of copper hydroxide containing dispersed particles of alumina. The precipitate was filtered and washed to remove any soluble salts. The filter cake was then dried in an oven at 175° C. (347° F.), whereby it was converted from a blue copper hydroxide to a black copper oxide form in which individual particles of alumina were surrounded by particles of copper oxide.

After the copper oxide had been prepared, it was placed into quartz boats and loaded into a tube furnace, where a mixture of nitrogen and hydrogen was passed over the oxide to reduce it to metallic copper. The temperature of the reduction was controlled to prevent premature sintering. More particularly, the furnace temperature was maintained at 200° C. (392° F.) for two hours, and was then increased to 400° C. (752° F.) for another two hours. The resulting material was a copper-alumina powder in which individual particles of alumina were surrounded by copper particles.

At 400° C. (752° F.), there is mild sintering of the copper particles. As used herein the term "mild sintering" refers to a decrease in surface area of the material undergoing sintering (copper particles) of about 10 to 50 fold.

The copper-alumina powder from the reducing step was thereafter never exposed to an atmosphere containing oxygen.

Billets of 1 inch (2.5 cm) diameter and about 3/16 inch (0.47 cm) thick were prepared by pressing the copper-alumina powder at 20 tsi (tons per square inch). These billets were hydrogen treated to reduce any surface copper oxide. Treatment temperature was slowly raised to 600° C. (1112° F.). Thereafter, the billets were kept in an inert atmosphere, totally oxygen free, until they were added to a molten aluminum-magnesium alloy. An argon atmosphere free of oxygen was maintained around the melt.

At 600° C. (1112° F.), there will be mild sintering of the copper particles in the billet, and it is desirable to produce mild sintering of at least the exterior surface of the billet to reduce the dissolution rate of the billet in the molten bath of aluminum alloy to which the billet is added. Gross sintering, in which there is a decrease in the surface area of the copper particles of over 100 fold, is undesirable and should be avoided. In a typical dispersion containing up to 20 vol. % alumina particles surrounded by copper particles, mild sintering will occur at temperatures up to about 700° C. (1292° F.), for example. Gross sintering occurs at 900° C. (1652° F.), for example. The maximum temperature at which gross sintering can be avoided is 800° C. (1472° F.).

The copper-alumina billet described above was added to a molten bath prepared as follows: 135 grams of 99.7% aluminum chips and 9 grams of magnesium were placed in a graphite crucible and melted at 900° C. (1652° F.) in an inert atmosphere (argon). To this molten metal was added 6 grams of the copper-alumina billet previously described. The billet contained 10 vol. % alumina particles dispersed therein and having a mean particle size of 0.030 microns. The melt was stirred with a graphite rod and with bubbling argon, held at 900° C. (1652° F.) for one hour and then cast. There resulted an Al-4Cu-3Mg (4 percent copper, 3 percent magnesium by weight) alloy having alumina particles dispersed therein.

Thin foils of the alloy were prepared by warm roling thin sections of the alloy followed by jet electropolishing. The electrolyte employed was 750 ml. methanol, 225 ml. glycerol and 25 ml. perchloric acid. Polishing was performed at 25° C. (77° F.) using a voltage of 26 to 30 volts. Perforated 3 mm discs were prepared and cleaned immediately in ethanol. The specimens were examined with a JEM-200 CX electron microscope operating at 200 kilovolts. Qualitative chemical analyses of the various microconstituents were obtained through an Energy Dispersive Spectroscope (EDS) using a KEVEX detector and analyzer.

The microstructure of the alloy consisted of three distinctly different particles in an aluminum matrix. The first type of particle was found exclusively at grain boundaries and had a very smooth, spherical morphology. When analyzed with EDS, the composition of these particles was found to be primarily silica. It is suspected that these particles were present as an impurity oxide. The silica particles were about 1 micron in size.

The second type of particle, also about 1 micron, was also located primarily at grain boundaries. Chemical analysis of these particles found them to be primarily aluninum with a large amount of copper and a small amount of magnesium. It is believed that these particles are $\theta$ precipitates resulting from incomplete dissolution of the billet. Upon examination, these particles were shown to contain alumina particles dispersed therein.

The third type of particles were alumina, which were on the order of 0.03 microns in diameter. These alumina particles were also found to be uniformly dispersed in the alloy matrix. The volume of the alumina particles, as calculated from the ingredients used, was 0.1 vol. %. The interparticle spacing was thereby calculated from the relationship described above to be 0.2 microns.

The microstructure of the cast composition is similar in appearance to that of SAP, indicating that cast or welded parts would be expected to maintain physical properties similar to those of SAP.

EXAMPLE 2

A coprecipitate of copper-zirconia was prepared as follows: 100 grams of copper were dissolved in 300 milliliters of concentrated nitric acid, and 100 milliliters of water. The final volume of the resulting copper nitrate solution was adjusted to 500 milliliters by adding water. A colloidal aquasol containing discrete particles of zirconium oxide (zirconia) was purchased from Johnson Matthey. The zirconia particles had a mean size of 0.005 microns. To a volume of this zirconia sol which corresponds to 12.34 grams of zirconia, distilled water was added to make 500 milliliters. Into a vessel containing a heel of 100 ml. of water, the copper nitrate solution and the zirconia sol were metered simultaneously at equal rates with very vigorous stirring. Simultaneously, sufficient ammonia gas was added to maintain the pH at 5.5 ±0.1. The solutions were added over a period of 1 hour. After precipitation was completed, the precipitate was filtered, washed with distilled water, and dried at 290° C. (554° F.).

The resulting black copper oxide containing dispersed zirconia was pulverized to 100 mesh and reduced in hydrogen at 300° C. (572° F.) until no more water was evolved by the reducing reaction, and then the temperature was raised to 700° C. (1292° F.) for 1 hour. The product resulting from this step was a powder-like dispersion of mildly sintered copper particles surrounding individual, discrete zirconia particles dispersed throughout.

The copper-zirconia powder was bottled in an oxygen free atmosphere and transferred to a glove box containing an inert atmosphere. The oxygen content of the gas in the glove box was less than 0.05 wt. %. The powder was transferred to a press and pressed into a slug, at a pressure of 32 tons per square inch, in said inert atmosphere. The oxygen content in the form of copper oxide in the slugs was less than 0.01% of the weight of the copper.

91 grams of pure aluminum turnings and 4 grams of magnesium were added to a melting vessel in the inert atmosphere of the glove box. The metals were melted and raised to a temperature of 900° C. (1652° F.). Copper-alumina slugs containing 4.9 grams of total copper were added to the melt in said inert atmosphere, and the melt was maintained at a temperature of 900° C. (1652° F.) for a period of one-half hour. The melt was then cast in a steel mold and the casting was formed into an extrusion. The casting was a cylinder having a diameter of 1 in. and a length of 5 in. (2.5 cm by 12.5 cm), and the extrusion was a rod having a diameter of 0.25 in. (0.625 cm).

The Vickers microhardness of the cast and extruded product was 150 dph versus 65 for a control product having the same composition except for the zirconia. The grain size as cast was 76 microns versus 25 microns for the control product, and after converting to T6 condition the grain size was 21 microns versus 45 microns for the control product. T6 refers to a thermal treatment involving solution heat treatment at about 500° C. (932° F.), quenching in water and aging for about 9–11 hours at about 177° C. (350° F.). The finer grain size in the product of the present invention compared to the control, after T6 treatment, reflects grain growth retardation due to the dispersed strengthening oxide. A smaller grain size is desirable because it imparts greater strength to the product.

EXAMPLE 3

This example is similar to Example 2 (the same copper-zirconia powder was used), except that 10 weight percent copper was added to a melt of aluminum—1% magnesium. The product was cast and extruded, and the tensile strength thereof at 600° F. (316° C.) was measured and found to be twice that of a control product containing no zirconia.

EXAMPLE 4

This example is similar to Example 2, except that alumina having a mean particle size of 0.005 microns was used as the dispersoid. The grain size in an as cast 2024 aluminum alloy was about half that of the same alloy without the dispersoid (the control), and there was an increase in the relative difference in grain size after aging the casting at 600° F. (316° C.) for 100 hours. Compared to the control, tensile strength was improved by a factor of two at 600° F. (316° C.), and the improvement persisted after aging at 600° F. (316° C.) for 100 hours.

As noted above, an important feature of the present invention is the mean particle size of the strengthening oxide. For a given volume thereof, any increase in the size of the particles (as by coagulation or aggregation) results in an increase in interparticle spacing and a decrease in strength. A strengthening oxide having the desired particle size (0.025 microns max.) can be provided initially, but care must be exercised to avoid aggregation or coagulation during the various processing steps to which the particles of strengthening oxide are subjected before the final metallic product is produced.

Aggregation of the strengthening oxide can be avoided by keeping the particles thereof separated from each other, and this can be accomplished by surrounding the individual particles of strengthening oxide with other particles during the various processing steps. These other particles are particles of the second oxide (e.g. copper oxide or iron oxide) or particles of the metal chemically reduced from the second oxide, depending upon the processing stage. Care must also be taken to avoid aggregation or coagulation of the surrounding particles because when that occurs, the particles of strengthening oxide get pushed aside to where they are no longer surrounded by or mechanically entrapped by the other particles (i.e. by the second oxide or metal particles); and when that happens, aggregation of the particles of strengthening oxide cannot be readily avoided.

Aggregation of adjacent particles is promoted by temperature stresses. Initially there can be holes or voids between adjacent particles (i.e. a gel-like structure), but under the influence of temperature stresses, the particles tend to fill in or close the voids, at first forming neck-like connecting structures between adjacent particles and then filling in more and more of the holes and voids, forming structures more and more egg-like in shape as groups of 10 to 50 adjacent particles aggregate in this fashion. Eventually, a multiplicity of smaller particles coalesce into one spherical particle.

The mechanism described in the preceding paragraph applies to the particles of copper oxide surrounding the particles of strengthening oxide, and when the former coalesce, the latter are no longer surrounded by copper oxide particles to the extent that they previously were, and there is more room for movement by the particles of strengthening oxide which are then more likely to aggregate in the manner described above. If aggregates of 10 to 50 particles are formed, and substantially all the particles of strengthening oxide aggregate in this fashion, the number of particles available for strengthening is reduced by a factor of 10 to 50 and the interparticle spacing is increased by the same factor.

It is therefore desirable to avoid conditions which reduce the extent to which the particles of strengthening oxide are surrounded or mechanically entrapped by other particles (e.g. copper oxide or copper). It is also desirable to reduce the conditions which allow the particles of strengthening oxide to be pushed aside by the other particles or which allow movement by particles of strengthening oxide. One should thus minimize, to the extent practically possible, the amount of holes or voids in mixtures of the particles of strengthening oxide and said other particles.

Aggregation can occur during various stages of the process described above, and practices should be followed which minimize the opportunities for aggregation to occur during each of these stages. Thus, during the coprecipitation stage, in which copper oxide, for example, is coprecipitated with colloidal alumina, one should preferably employ concentrated solutions (e.g. 3 molar copper nitrate solution) and introduce the solutions into the mixing vessel at a location of vigorous agitation. More concentrated solutions produce compact coprecipitates which have less volume occupied by voids and holes and thus reduce the opportunity for aggregation, particularly during the drying phase of the coprecipitation stage. A compact coprecipitate is one in which the volume occupied by holes or voids is less than the volume occupied by the particles.

During the reduction stage in which the copper oxide is converted to copper, there is a tendency for the copper particles to decrease their surface area because of surface energy (i.e. to sinter), and as their surface area decreases, if the particles of strengthening oxide are rejected or pushed aside, then the latter can aggregate or coalesce at that stage in the process. Gross sintering of the copper particles after reduction should be avoided by limiting the final temperature to below 800° C. (1472° F.).

Aggregation can occur in the molten bath after the billet is added, particularly if there is copper or iron oxide present. Copper or iron oxide tends to react with the wetting metal, e.g., magnesium, to form magnesium oxide (magnesia). The magnesia as it forms tends to collect the particles of strengthening oxide, e.g. alumina, in the form of a magnesium aluminate. When many particles of alumina are thus collected together, this decreases the number of such particles in the product and increases the interparticle spacing, which results in a decrease in strength at elevated temperatures. It is therefore preferred that the copper or iron oxide content of the billet be controlled so that the oxygen present as copper or iron oxide be less than 0.05% of the weight of the copper or iron in the billet and even more preferred if it is less than 0.01%.

Aggregation also can occur in the molten bath if the copper-alumina billet dissolves too quickly. It is preferred to press the copper-alumina powder and mildly sinter the pressed billet to reduce its surface area and thus reduce the rate of dissolution. In addition, the rate of dissolution can be reduced by controlling the temperature of the molten bath to 100°–150° C. above the melting point of the molten bath (i.e. of the aluminum alloy).

After the billet has completely dissolved in the molten bath, the dispersed particles of strengthening oxide can grow by a phenomenon known as Ostwald ripening. For this reason it is important to select a strengthening oxide which has a low solubility in the molten metal, in which case the strengthening oxide will have little tendency to grow in the molten metal. Should the particles grow by Ostwald ripening, they can easily achieve sizes greater than 0.025 microns, and the effective high temperature strengthening mechanism will be lost. In order to avoid Ostwald ripening, both the free energy of formation of the strengthening oxide and the melting point thereof should be relatively high. Oxides which have free energies of formation less than that of zirconia are not preferred, and it is preferred that the dispersoid have a melting point greater than 1500° C. (2732° F.).

The foregoing detailed description has been given for clearness of understanding only, and no unnecessary limitations should be understood therefrom, as modifications will be obvious to those skilled in the art.

I claim:

1. A method for producing a metallic product having a matrix consisting essentially of aluminum with discrete particles of strengthening oxide dispersed throughout the matrix, said method comprising the steps of:

providing a volume of said strengthening oxide in the form of discrete particles having a mean particle size no greater than 0.025 microns;

surrounding said discrete particles of strengthening oxide with a sufficient amount of particles of a second oxide, selected from the group consisting of copper oxide and iron oxide, to maintain the particles of strengthening oxide separate and discrete from each other and to form a first dispersion consisting essentially of up to 20 vol. % of said particles of strengthening oxide dispersed in said second oxide;

reacting said second oxide in said first dispersion with hydrogen at an elevated temperature to reduce the second oxide to a metal;

continuing said reacting step until the oxygen content of any unreduced second oxide from the first dispersion is less than 0.1 wt. % of the amount of said metal reduced from the second oxide;

forming, as a result of said reacting step, a second dispersion consisting essentially of said discrete particles of strengthening oxide dispersed in substantially oxygen-free particles of said metal which surround said discrete particles of strengthening oxide;

pressing said second dispersion into a compressed form;

providing a molten bath consisting essentially of aluminum as the predominant component and including a wetting metal for said strengthening oxide;

adding said compressed form, in a substantially oxgen-free condition, to said molten bath, to disperse said discrete particles of strengthening oxide substantially uniformly throughout said molten bath;

slowly dissolving into said molten bath, the metal surrounding said particles of strengthening oxide;

preventing said particles of strengthening oxide from aggregating during the above-recited steps;

and then pouring said molten bath containing said dispersed strengthening oxide into a casting form.

2. A method as recited in claim 1 wherein:

said strengthening oxide constitutes 5-20 vol. % of said first dispersion.

3. A method as recited in claim 1 wherein said step of preventing aggregating comprises:

avoiding gross sintering of said metal particles during said reacting step.

4. A method as recited in claim 3 and comprising:

limiting the temperature during said reacting step to no greater than about 800° C. (1472° F.).

5. A method as recited in claim 1 and comprising:

before said adding step, heating said compressed form in an oxygen-free atmosphere to produce mild sintering of at least those metal particles on the surface of the compressed form.

6. A method as recited in claim 5 and comprising:

limiting the temperature, during said mild sintering of said compressed form, to no greater than about 700° C. (1292° F.).

7. A method as recited in claim 1 wherein said step of preventing aggregating comprises:

preventing said metal particles from aggregating during said reacting step;

and preventing the formation of surface oxide on said compressed form.

8. A method as recited in claim 7 wherein:

said metal particles are composed of copper.

9. A method as recited in claim 1 wherein:

said strengthening oxide has a free energy of formation greater than 100K Cal/gram atom of oxygen in said strengthening oxide.

10. A method as recited in claim 9 wherein:

said strengthening oxide has a melting point sufficiently greater than the melting point of said molten bath as to be stable in said molten bath.

11. A method as recited in claim 10 wherein:

said strengthening oxide has a melting point above 1500° C. (2732° F.);

and the temperature of said molten bath is below the melting point of said strengthening oxide.

12. A method as recited in claim 10 wherein:

said strengthening oxide is selected from the group consisting of magnesia, alumina, zirconia, thoria and oxides of the rare earth metals having an atomic number from 59 to 71.

13. A method as recited in claim 1 wherein:

said molten bath includes a wetting metal for said strengthening oxide;

and said method comprises wetting said discrete particles of strengthening oxide with said wetting metal, during said adding step, to promote the dispersion of said strengthening oxide as discrete particles thereof.

14. A method as recited in claim 13 wherein:

said strengthening oxide is alumina;

and said wetting metal is magnesium.

15. A method as recited in claim 1 wherein:

said surrounding step comprises coprecipitating, from solution, both (a) particles of said strengthening oxide and (b) particles of either said second oxide or a compound chemically reducible to produce said second oxide.

16. A method as recited in claim 15 wherein:

said chemically reducible compound is an hydroxide;

and said surrounding step comprises heating said hydroxide to convert it to said second oxide.

17. A method as recited in claim 1 wherein:

said metal surrounding said particles of strengthening oxide is slowly dissolved in said molten bath by limiting the temperature of the molten bath to no greater than about 150° C. above the melting point of said molten bath.

18. A method as recited in claim 1 wherein:

said pressing step is performed in an oxygen-free atmosphere, to prevent re-oxidation of said substantially oxygen free metal.

19. A method as recited in claim 18 wherein:

said adding step is performed in an oxygen-free atmosphere.

20. A method as recited in claim 1 wherein:

prior to said adding step, said compressed form is subjected to a reducing atmosphere, at an elevated temperature, to reduce any oxide which may have formed after said reacting step.

21. A method as recited in claim 1 and comprising:

maintaining said first and second dispersions and said compressed form in an oxygen-free atmosphere between said first-recited surrounding step and said adding step.

* * * * *